United States Patent [19]

Clemmens

[11] 4,018,043

[45] Apr. 19, 1977

[54] GAS TURBINE ENGINES WITH TOROIDAL COMBUSTORS

[75] Inventor: William B. Clemmens, Ann Arbor, Mich.

[73] Assignee: Avco Corporation, Stratford, Conn.

[22] Filed: Sept. 19, 1975

[21] Appl. No.: 614,754

[52] U.S. Cl. ..... 60/39.27; 60/39.36; 60/39.69; 60/39.74 R; 60/39.66

[51] Int. Cl.[2] ..... F02C 9/08

[58] Field of Search ..... 60/39.27, 39.36, 39.69, 60/39.74

[56] References Cited

UNITED STATES PATENTS

| | | | |
|---|---|---|---|
| 2,575,682 | 11/1951 | Price | 60/39.16 |
| 3,010,281 | 11/1961 | Cervenka | 60/39.16 X |
| 3,045,894 | 7/1962 | Ross | 60/39.27 X |
| 3,196,847 | 7/1965 | Kimberley | 123/8.13 |
| 3,269,119 | 8/1966 | Price | 60/39.36 |
| 3,287,905 | 11/1966 | Bayard | 60/39.36 |
| 3,603,082 | 9/1971 | Sneeden | 60/39.36 |
| 3,613,360 | 10/1971 | Howes | 60/39.36 |
| 3,626,694 | 12/1971 | Holste | 60/39.69 |
| 3,645,095 | 12/1972 | Melconian | 60/39.36 |

*Primary Examiner*—Clarence R. Gordon
*Attorney, Agent, or Firm*—Irwin P. Garfinkle; Edmund S. Lee; Charles M. Hogan

[57] ABSTRACT

A gas turbine engine is described in which a compressor, combustor and turbine are arranged in series flow relationship. Pressurized air enters the combustion chamber with approximately the same swirl as imparted to it by the compressor rotor, through an annular inlet tangentially of and at the outer bounds of the combustion chamber which has a toroidal configuration. This creates a vortex which swirls annularly and in which combustion of fuel is maintained. Mixing action in this vortex is enhanced through the introduction of additional air through chutes formed in the combustion chamber liner. The hot gas stream is discharged from the combustion chamber through an exit also at the outer bounds and tangentially thereof. In one embodiment fuel is introduced by means of nozzles aligned with the discharge ends of the chutes. In another embodiment the combustion chamber inlet is in the form of a venturi passageway and fuel is introduced into the inlet air by ports at the venturi throat. Vanes at the entrance end of the inlet control the entry swirl angle and flow rate. Differential pressure inputs from the compressor discharge and the venturi throat to a carburetor, control fuel flow as a function of a throttle lever signal establishing the angular position of the vanes.

10 Claims, 4 Drawing Figures

FIG 3
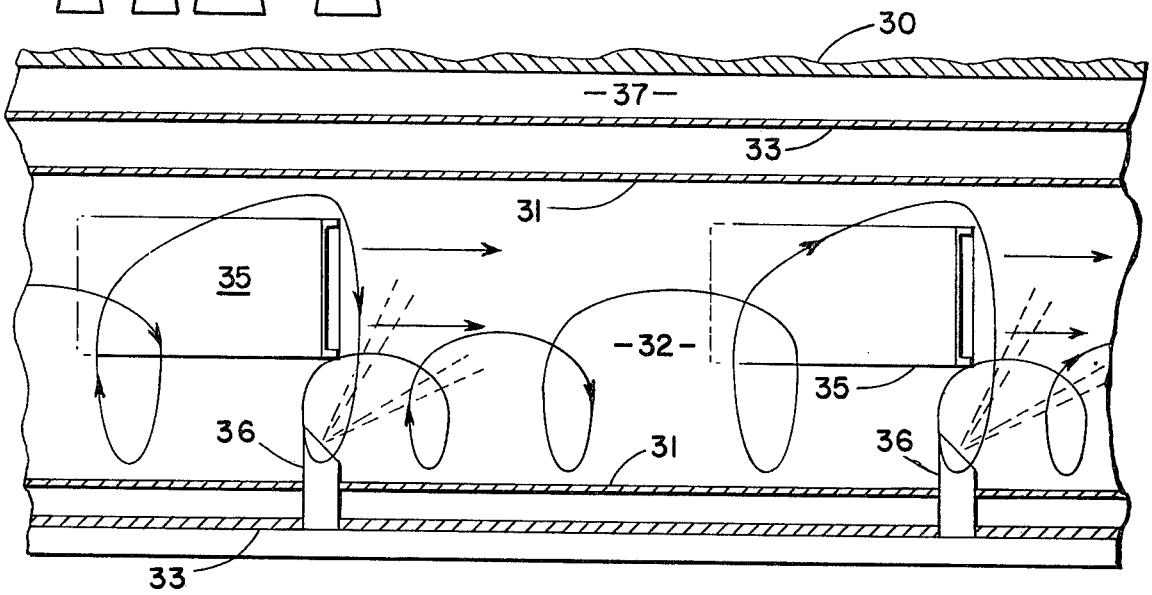
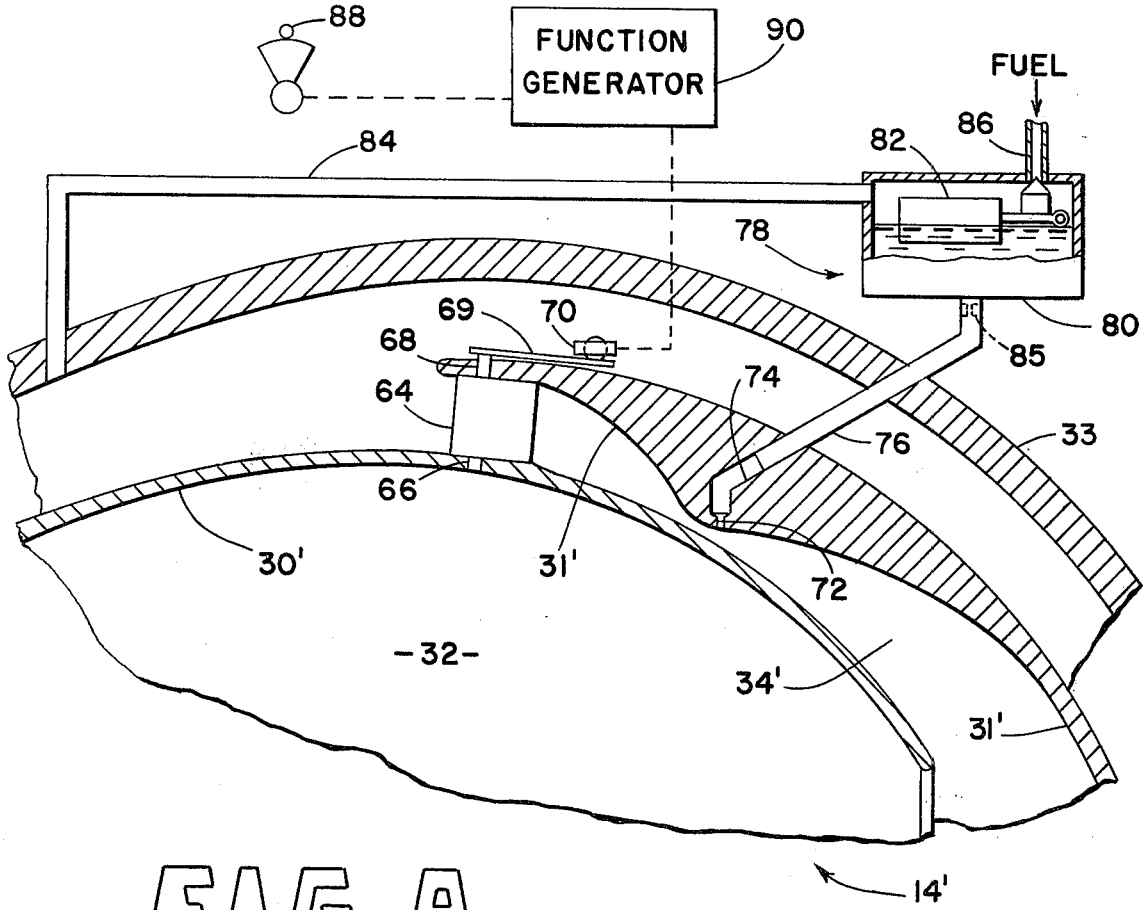
FIG 4

GAS TURBINE ENGINES WITH TOROIDAL COMBUSTORS

The present invention relates to improvements in gas turbine engines and more particularly to gas turbine engines incorporating improved toroidal combustors.

Gas turbine engines basically comprise, in series flow relationship, a compressor for pressurizing an air stream, a combustor in which the pressurized air supports combustion of fuel in the generation of a high energy, hot gas stream, and a turbine which extracts a portion of the energy of the hot gas stream to drive the rotor of the compressor, these components being commonly referenced as a gas generator. The major portion of the remaining energy of the hot gas stream is then converted to a useful output, as by being discharged through a propulsion nozzle in the flight of an aircraft, or by driving a power turbine from which motive shaft power may be derived.

One of the basic goals in the development of gas turbine engines, particularly in the flight propulsion field, is to obtain maximum thrust or shaft horsepower from an engine of minimum weight and maximum compactness. The combustor, as a major engine component, contributes significantly to both the weight and bulk of an engine.

Today, there are only two types of combustor having widespread use in high performance, gas turbine engines. One is the through flow type which may be relatively small in diameter, but contributes significantly to overall engine length. The other is the reverse flow type which contributes significantly to engine diameter, but permits a shorter engine length. Through flow combustors are most commonly used in axial flow engines, while reverse flow combustors are usually employed in radial flow engines. In axial flow engines fluid flow through the compressor and turbine is generally in an axial direction. In radial flow engines, fluid flow through the compressor or turbine, or both, is in a radial direction relative to the axis of these components.

In both types of combustor, the combustion process takes place while the air and fuel are flowing in an essentially axial direction. The length of the combustor thus becomes a function of the time required to complete the combustion process. Combustor length is further a function of the time required to admix secondary cooling air to the hot gas stream before it enters the turbine. This is necessary since the peak temperatures generated during the combustion process are so great that the turbine components would either burn out or have their life shortened if the hot gas stream were not cooled by secondary air.

Another shortcoming of such conventional combustors is that it is necessary to remove the swirl angle imparted to the air by the compressor rotor, before entry of the air into the combustor's combustion chamber. Thereafter the hot gas stream must be angled to properly impinge the turbine rotor. In both instances turning losses are involved which decrease overall engine efficiency and the useable power available from the engine.

Toroidal combustors have previously been proposed to overcome such shortcomings and to provide other advantages. Basically, in a toroidal combustor an annular vortex is created within which the combustion process takes place. Since the combustion path is of infinite length, the primary limiting factor in reducing length and diameter of the combustor is the cross sectional area required for the combustion process.

The full potential of toroidal combustors has not been realized. Over-temperaturing of turbines remains a problem which is also a problem in the liners which define their combustion zones, and while some reductions in bulk have been attained, greater compactness and consequent reduction in weight provide incentive for further improvement.

Another feature of toroidal compressors is that they can lead to the elimination of turning losses previously involved in removing swirl and then angling the hot gas stream for entry to the turbine. However, the benefits to be gained can be offset, or more than offset, by turbine entry losses when operating at other than the engine's design point.

Accordingly, one object of the present invention is to provide a gas turbine engine incorporating an improved toroidal combustor.

Another object of the present invention is to minimize the weight and reduce the bulk of gas turbine engines through the provision of an improved toroidal combustor.

Another object of the present invention is to attain the above ends and further to minimize the possibility of overtemperaturing the engine's turbine and the liners defining its combustion chamber.

Another object of the present invention is to minimize losses in engines incorporating toroidal combustors, when operating at other than the design point and also to provide an improved control system for such engines.

These ends are attained, in accordance with the broader aspects of the invention, by a gas turbine engine comprising, in series flow relationship, a compressor, a combustor having a toroidal combustion chamber, and a turbine. The combustion chamber has an annular inlet tangentially of its outer bounds. Air enters through this inlet with approximately the same swirl angle imparted to it by the compressor rotor and creates an annular vortex within the combustion chamber. Combustion of fuel in this annular vortex generates a hot gas stream which is then discharged through an annular exit also tangential of the outer bounds of the combustion chamber and spaced from the inlet therefor.

The tangential fluid flow through the combustion chamber inlet and exit provides a mixing action which increases the rate of combustion and ensures against overtemperaturing of both the turbine and the combustor itself. Additional mixing can be obtained by introducing fuel into the pressurized air as it passes through the tangential inlet. Further mixing action can also be obtained by forming chutes in the liner means defining the combustion chamber. These chutes direct a portion of the pressurized air tangentially toward the vortex and in the direction of annular flow. Where fuel is introduced directly into the combustion chamber, nozzles are employed which are preferably aligned with the discharge ends of these chutes.

Where fuel is introduced in the tangential combustion chamber inlet, the flow passageway therethrough is preferably a venturi and the fuel is introduced through port means spaced around its throat.

A circumferential row of vanes may be provided in this tangential inlet and means for simultaneously adjusting the angular position of these vanes employed to modify and control the swirl angle of the air entering the combustion chamber, as well as its rate of flow. By thus controlling inlet swirl, a more effective angle of impingement of the hot gas stream on the turbine rotor can be obtained. Further, the fuel flow rate may be controlled as a function of the differential pressure between the throat and the compressor discharge. Adjustment of the angular position of the vanes in response to an input signal, as from a manually controlled throttle lever, provides a control system for operation of the engine.

Constructional features of the liner means and housing forming the combustion chamber and the inlet and exit thereof and the preferred relationships therebetween, as well as other related objects and features of the invention will be apparent from a reading of the following description of the disclosure, with reference to the accompanying drawings, and the novelty thereof pointed out in the appended claims.

In the drawings:

FIG. 3 is a projection taken generally on line 3—3 in FIG. 2; and

FIG. 4 is a fragmentary portion of the section of FIG. 1, on an enlarged scale, illustrating another embodiment of the invention.

Figure 1:
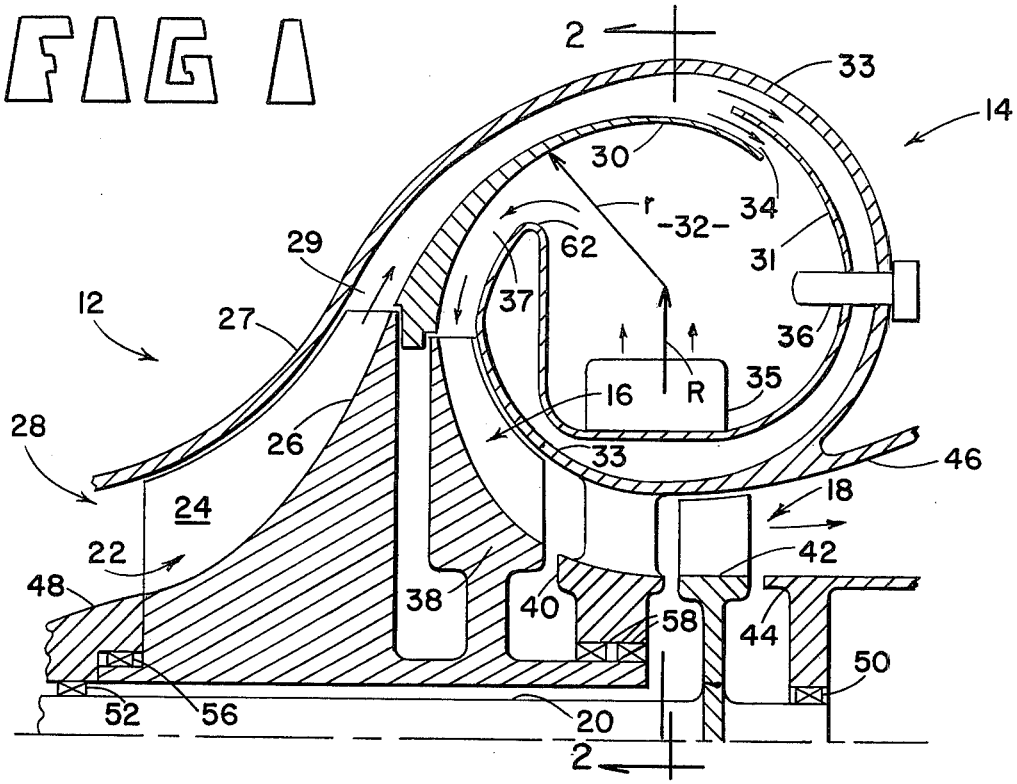
FIG. 1 is a simplified, schematic, longitudinal half section of a gas turbine engine embodying the present invention.

The gas turbine engine illustrated in FIG. 1 comprises the basic components of such engines, namely a compressor 12, a combustor 14 and a turbine 16, which are commonly referenced, collectively, as a gas generator. This gas generator produces a high energy, hot gas stream which drives a power turbine 18 from which motive power may be derived by way of an output shaft 20. Alternatively, this hot gas stream may be discharged through a nozzle for the propulsion of an aircraft.

The compressor 12 comprises an impeller 22 having blades 24 projecting from a hub 26 into close clearance relationship with a surrounding housing 27. The hub 26 defines, in combination with the housing 27, an annular compressor flow path which curves from a generally axially facing inlet 28 to an outwardly angled discharge exit 29. The compressor flow path is progressively reduced in area towards the discharge exit. Thus as the impeller 22 rotates, air is accelerated and its energy level increased as it passes through the compressor.

This pressurized air then supports combustion of fuel in the combustor 14 in the generation of the hot gas stream. The combustor 14 comprises liners 30 and 31 which define a toroidal combustion chamber 32. A combustor housing 33, preferably in spaced toroidal relation with the outer surfaces of the liners 30 and 31, defines in combination therewith the pressurized air flow path from the compressor to the combustor. At this point it will be noted that constructional details which would be within the abilities of those skilled in the art are not shown herein. Thus for example, the housings 27 and 33 are shown as a single structural unit, but in actual practice would be compositely formed.

Pressurized air enters the combustion chamber 32 through an inlet 34 and chutes 35. This pressurized air supports combustion of fuel introduced by nozzles 36 after ignition is had by appropriate means, not shown. The hot gas stream is then discharged through a combustion chamber exit 37 to the turbine 16.

The turbine 16 is of the centripetal type and comprises a bladed rotor 38 which rotates in close clearance relationship with the combustor housing 33. The housing 33 thus also defines the outer bounds of the hot gas stream flow path through the turbine 16. The turbine rotor 38 is directly coupled to the compressor impeller 22 to the end that the turbine 16 extracts a relatively small portion of the energy of the hot gas stream in driving the compressor 12 to pressurize the air stream.

The majority of the remaining energy of the hot gas stream is then converted to a useful output by the power turbine 18. The hot gas stream passes from the rotor 38 to a nozzle diaphragm 40 which directs it to the bladed rotor 42 of the power turbine. The hot gas stream is then discharged in a generally axial direction between a frame member 44 and a duct 46 extending from the housing 33.

The power turbine rotor 42 is mounted on the turbine output shaft 20 which extends in a forwardly direction to an inlet frame member 48. The shaft 20 may extend beyond the frame member 48 to provide motive power either directly of through a reducing gear box (not shown). The shaft 20 may be journaled on the frame members 44 and 48 by bearings 50 and 52. The compressor impeller 22 may be journaled on the frame member 48 by a bearing 56 and the turbine rotor 38 may be journaled on the turbine nozzle diaphragm 40 by bearings 58.

Figure 2:
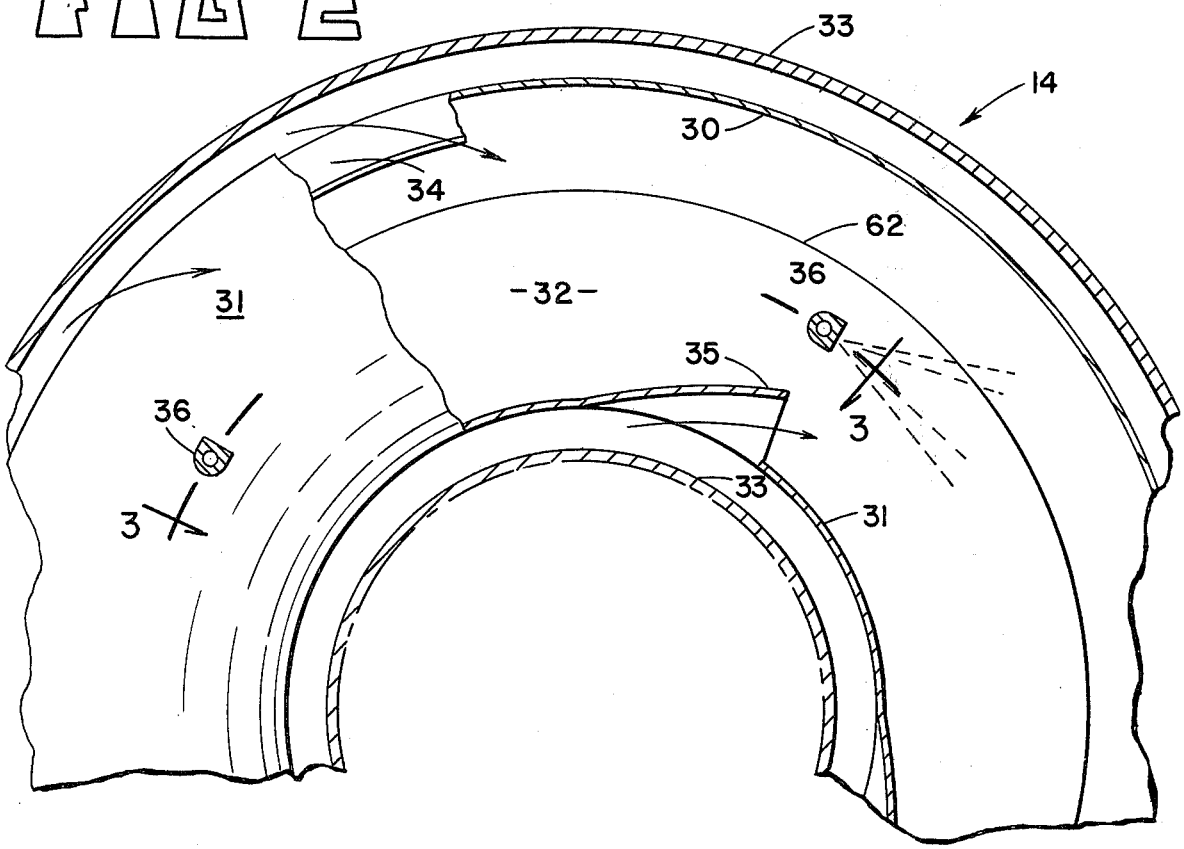
FIG. 2 is a section taken generally on line 2—2 in FIG. 1.

The fluid flow characteristics of the combustor 14 and particularly the combustion chamber 32 will now be described in detail with further reference to FIGS. 2 and 3. The combustion chamber 32 is toroidal and preferably closely approximates a torus, i.e., the combustion chamber is in the form of a circle generated approximately on a minor radius $r$ which is rotated about a major axis (which is coaxial with the engine rotor axis) on a major radius R. Further terms of reference herein are the minor diameter of the chamber toroid which is twice the minor radius $r$; the inner diameter of the chamber toroid which is the major radius R less the minor radius $r$; and the outer diameter of the chamber toroid which is the major radius R plus the minor radius $r$.

The liner 30 thus extends from the upstream side of the chamber toroid and then curves towards to its outer diameter, being extended therebeyond towards the downstream side thereof. The liner 31 has its upstream edge disposed approximately at the outer diameter of the chamber toroid and extends in overlapping, outwardly spaced relation from the liner 30 to the downstream side of the chamber toriod. The overlapping portions of the liners 30 and 31 define the combustion chamber inlet 34 which is tangential with the minor diameter of the chamber toroid at the outer bounds of the chamber and which has an entrance facing in the direction of compressor discharge flow.

The pressurized air, as it is discharged from the rotating impeller 22, has a tangential flow vector component, or swirl, which is maintained as it passes through the inlet 34 and enters the combustion chamber 32. This swirl generates an annular vortex within the combustion chamber into which fuel is introduced generally tangentially, in the direction of annular flow, by the nozzles 36. This basic approach to the generation of the annular vortex effectively maintains the combustion process within the combustion chamber and also cools the liners 30, 31 to ensure against their being overtemperatured.

The liner 31 also forms the inner diameter portion of the chamber toroid. The chutes 35 are formed in this inner diameter portion, being angled tangentially therefrom towards and in the direction of annular vortical flow. The fuel nozzles 36 are preferably aligned with the discharge ends of the chutes 35. The flow of air from the chutes 35 provides additional mixing action, by way of a "horse shoe" effect illustrated in FIG. 3, which accelerates the combustion process and minimizes the space requirements of the combustion chamber.

The liner 31 is extended radially, on the upstream side of the chutes 35 to a lip 62 where it joins an extension of the housing 33 at the entrance to the combustion chamber exit 37. The circumferential lip 62 is spaced inwardly from the inner surface of the liner 30 and is radially outward of the major radius R of the chamber toroid. The housing 33 extends from the lip 62 in overlapping, spaced relation from the inner surface of the liner 30 to define the exit 37 which is tangential of the minor diameter of the chamber toroid and at the outer bounds of the chamber. The hot gas stream is thus discharged radially inwardly to the centripital turbine 16. Since the hot gas stream is generated in the annular vortex within the combustion chamber, it also has a tangential flow vector component, or swirl, as it is discharged to the turbine 16. This enables the elimination of the customary turbine nozzle diaphragm which turns the hot gas stream to obtain the proper angle of impingement on the rotor of the gas generator turbine. While the fluid flow path from the compressor 12 to the turbine 16 is vaneless in the present embodiment, any need for vanes would involve only minimal turning losses as will be apparent from the following description of another embodiment of the invention.

Reference is now made to FIG. 4 which illustrates a modified, tangential, combustion chamber inlet 34'. The modified combustor 14' may be the same as that previously described, except for the inlet 34' and the elimination of the fuel nozzles 36.

The inlet 34' is again formed by overlapping portions of liners 30' and 31', with the liner 31' extending somewhat further in an upstream direction. The liner 31' is modified to form a venturi passageway for the pressurized air flowing through the inlet 34'. Upstream of the venturi is a circumferential row of vanes 64. The vanes 64 are pivotally mounted by radially extending pins 66, 68 on the liners 30' and 31' respectively. Levers 69 extend from the outer ends of each pin 68 to a unison ring 70 which may be rotated, relative to the major axis of the chamber toroid, to simultaneously adjust the angular position of the vanes 64. This variable geometry of the vanes 64 enables the swirl angle of the pressurized air entering the combustion chamber to be controlled and also provides a control over the flow rate of this air through the variable blockage of the vanes at different angular positions.

In the preferred combination of features of FIG. 4, fuel is introduced into the pressurized air stream as it flows through the inlet 34'. This further increases the mixing action and increases the rate of combustion as well as insuring more complete combustion which will tend to minimize pollutants.

To this end, a plurality of ports 72 are formed in the liner 31', opening into the throat of a venturi passageway and spaced therearound. Each port 72 is connected by a passageway 74 to a conduit 76 which extends through the housing 33 to a carburetor 78. The carburetor comprises a fuel reservoir 80 and a float valve 82. The conduits 76 are connected to the lower portion of the reservoir 80 while a conduit 84 connects the upper portion thereof to the compressor discharge flow passageway, between the liner 30' and the housing 33. A metering orifice 85 is provided at the entrance of the conduit 76. Admission of fuel into the reservoir 80 from a conduit 86 is controlled by the float valve 82 as a function of the fuel level in the reservoir.

The level of fuel in the reservoir 80 is also a function of the differential in pressure between the compressor discharge and the throat of the venturi inlet passageway. Since the variable geometry of the vanes 64 permits control of air flow rate and the pressure at the venturi throat as well, the engine control system may be directly based on vane position.

A manually operated throttle lever 88 may be connected mechanically to a function generator 90 which in turn provides a mechanical input for rotating the unison ring 70 and adjusting the angular position of the vanes 64. The function generator may be programmed to provide the proper degree of rotation to the unison ring throughout the full range of throttle movement from minimum to maximum power output, bearing in mind limits on acceleration and deceleration rates. When the unison ring is rotated to increase the flow rate of air, the throat pressure decrease, increasing the pressure differential across the reservoir 80 and the rate of fuel flow. This in turn increases the energy level of the hot gas stream and increase the rate of rotation of the turbine and compressor rotors all to the end of obtaining an increase in the power output of the engine with the rate of fuel flow being automatically increased to meet this demand. The system will stabilize when the fuel flow rate matches the requirement for a given air flow rate. A throttle lever input signal calling for a reduction in power would cause a reduction in air flow rate and fuel flow rate in a similar fashion.

Where fuel flow is controlled in this fashion, the mass flow of air through the chutes 35 should be balanced relative to inlet 34' in order to maintain the correct fuel to air ratio, proper turbine entry angle, and turbine inlet temperature.

This would normally mean that the fuel to air ration in inlet 34' would be richer than the engine fuel to air ratio. Thus a fictitious primary zone would be created where the richer mixture would ignite easier and maintain a more stable combustion process. Air mass entering the chamber through chutes 35 mixes with and cools the hot gas mixture in the primary zone.

The described float type carburetor provides a simple and economical control system for relatively stable engine operating environments. Where the engine is to be used in flight propulsion, or in other applications involving rapid accelerations and decelerations or changes in attitude, a more elaborate control may be required, but nonetheless would still be responsive to the differential in pressure between the compressor discharge and the venturi throat in controlling the rate of fuel flow.

While the vanes 64 are employed to control air flow rate, they also control the swirl angle of the air entering the combustion chamber 32. This permits the entry swirl angle to be modified to obtain a more effective impingement angle of the hot gas stream on the turbine rotor 38. Since the vanes are generally aligned with the swirl angle imparted to the air by the compressor impeller, turning angles and turning losses are quite small. Further it will be noted that changes in swirl angle resulting from varying the air flow rate are consistant with turbine rotor impingement requirements.

While it is preferred that the toroidal combustion chamber be essentially in the form of a torus it is essential that an annular vortex be generated within the combustion chamber through the introduction of pressurized air through an annular inlet tangentially of its outer bounds. Thus other sections, such as an oval, of revolution could comprise the toroidal chamber. Also it will be noted that both radial flow and axial flow compressors and turbines could be employed in combination with combustors embodying the present inventive concepts is therefor to be derived solely from the appended claims.

Having thus described the invention, what is claimed as novel and desired to be secured by Letters Patent of the United States is:

1. A gas turbine engine comprising, in series flow relationship, a compressor, including a rotor, for pressurizing an annular stream of air and imparting thereto a tangential flow vector component, a combustor comprising a toroidal combustion chamber having inlet means for the introduction of the compressed air therein and a discharge exit for a hot gas stream generated in the combustor, said chamber being generally a circular section rotated about the rotor axis, said combustor comprising liner means also of toroidal configuration, the inner surface of which defines the outer bounds of the combustion chamber, said engine including a housing also of toroidal configuration and outwardly spaced from said liner means and defining in combination therewith the compressed air flow path from the compressor to the combustion chamber, the housing and liner means extending from their upstream ends at the compressor discharge, to downstream end portions leading to the combustion chamber inlet means, said inlet means comprising a primary annular inlet for at least the major portion of the pressurized air, said primary inlet guiding the pressurized air tangentially of the minor axis of the toroidal combustion chamber, whereby the compressed air creates an annular vortex within said combustion chamber, said combustor further comprising means for introducing fuel into said vortex and maintaining combustion thereof in an endless combustion path to thereby generate the high energy hot gas stream, said housing extending through at least 360° relative to said minor toroid axis with the outer surface of the downstream end thereof being spaced inwardly from the inner surface of said combustor liner means, to define an annular combustion chamber discharge exit tangentially of the minor axis of the chamber, through which the hot gas stream passes with a substantial tangential component derived from the compressor, and a turbine having a rotor driven by the hot gas stream discharged from the combustion chamber exit and coupled to the compressor rotor to drive the latter.

2. A gas turbine engine as in claim 1 wherein fuel introducing means are disposed in said combustion chamber inlet, whereby the fuel and air are mixed prior to entering the annular vortex.

3. A gas turbine engine as in claim 2 wherein the combustion chamber inlet is in the form of a venturi passageway, and the fuel introducing means comprise a plurality of port means opening into the throat of the venturi passageway and spaced therearound.

4. A gas turbine engine as in claim 1 further comprising a circumferential row of vanes disposed in the combustion chamber inlet, said vanes being generally aligned with the swirl angle of the pressurized air entering said inlet, and means for simultaneously adjusting the angular position of said vanes to modify and control the swirl angle and also to control the flow rate of air entering the combustion chamber,

5. A gas turbine engine as in claim 4 wherein said row of vanes id disposed at the entrance end of the combustion chamber inlet, the combustion chamber inlet is in the form of a venturi passageway downstream of said row of vanes, and a plurality of port means opening into the throat of the venturi passageway and spaced therearound, said port means introducing fuel into the pressurized air as it flows through the inlet so that the air and fuel are mixed prior to entering the annular vortex.

6. A gas turbine engine as in claim 5 further comprising means for generating a signal indicative of a desired power output from said engine, said vane adjusting means being responsive to and adjusting the angular position of said vanes to control the flow rate of air entering the combustion chamber proportionate to said signal, and means for controlling the rate of fuel flow to said port means proportionate to the differential in pressure between the compressor discharge and the throat of the venturi passageway.

7. A gas turbine engine as in claim 6 wherein the means for controlling the rate of fuel flow comprises a carburetor including a fuel reservoir, a conduit connection between the upper portion of said reservoir and the compressor discharge flow passageway, a conduit connection with metering orifice between the lower portion of said reservoir and said port means, and float valve means for controlling the fuel level of fuel in said reservoir.

8. A gas turbine engine as in claim 5 wherein the combustion chamber is defined by first and second liners, said first liner extends from the upstream side of the chamber toroid to the outer diameter thereof and then curves towards the downstream side thereof, said second liner has an upstream edge approximately at the outer diameter of the chamber toroid and extends therefrom, in overlapping spaced relation from the outer surface of said first liner, to the downstream side of the chamber toroid, thereby defining the combustion chamber inlet with an entrance facing towards the direction of the compressor discharge flow, said vanes are pivotally mounted on the overlapping portions of said liners, and a combustor housing is in outwardly spaced relation from said first and second liners to define therewith the flow passageway for pressurized air flowing to said combustor, said housing extending in overlapping, inwardly spaced relation from the inner surface of said first liner, from the upstream side of the chamber toroid to a circumferential lip outwardly of the major radius of the chamber toroid, thereby defining the combustion chamber exit which discharges the hot gas stream radially inwardly towards said turbine.

9. A gas turbine engine as in claim 8 wherein said second liner also forms the inner diameter portion of the chamber toroid and a plurality of chutes are formed in and spaced around said inner diameter portion, said chutes being angled inwardly from said inner toroid diameter in a direction normal to the major axis and extending tangentially towards said vortex and in the direction of annular flow, said chutes being sized to introduce a relatively small amount of air into the combustion chamber relative to the amounted introduced through said tangential inlet.

10. A gas turbine engine as in claim 9 further comprising means for generating a signal indicative of a desired power output from said engine, said vane adjusting means being responsive to and adjusting the position of said vanes to control the flow rate of air entering the combustion chamber proportionate to said signal, and means for controlling the rate of fuel flow to said port means proportionate to the differential in pressure between the compressor discharge and the venturi throat of the inlet passageway, and wherein said turbine is of the centripetal type.

* * * * *